United States Patent [19]

Takikawa et al.

[11] 4,449,919

[45] May 22, 1984

[54] GAS COMBUSTION APPARATUS CAPABLE OF DETECTING ENVIRONMENTAL OXYGEN DEFICIENCY

[75] Inventors: Osamu Takikawa, Chigasaki; Masaki Katsura, Yokosuka; Chiaki Tanuma, Tokyo; Katsunori Yokoyama, Ebina, all of Japan

[73] Assignee: Tokyo Shibaura Denki Kabushiki Kaisha, Kawasaki, Japan

[21] Appl. No.: 269,757

[22] Filed: Jun. 2, 1981

[30] Foreign Application Priority Data

Jul. 10, 1980 [JP] Japan ..... 55-96210[U]
Jul. 10, 1980 [JP] Japan ..... 55-96211[U]

[51] Int. Cl.[3] ..... F23H 5/24

[52] U.S. Cl. ..... 431/76; 236/15 E; 204/286; 204/283; 204/291; 204/292; 204/421; 204/426; 204/429

[58] Field of Search ..... 431/75, 76, 80; 236/15 E; 204/195 S, 286, 429, 421, 426; 73/23

[56] References Cited

U.S. PATENT DOCUMENTS

| | | | |
|---|---|---|---|
| 3,645,875 | 2/1972 | Record et al. | 204/195 S |
| 3,940,327 | 2/1976 | Wagner et al. | 204/426 X |
| 4,032,286 | 6/1977 | Kobayashi et al. | 431/76 |
| 4,040,930 | 8/1977 | Dillon | 204/426 X |
| 4,121,988 | 10/1978 | Sano et al. | 204/426 X |
| 4,125,356 | 11/1978 | Ohashi et al | 431/80 |
| 4,154,664 | 5/1979 | Renoxot | 204/428 X |
| 4,155,828 | 5/1979 | Takao et al. | 204/426 |
| 4,189,355 | 2/1980 | Fujishiro et al. | 204/426 X |
| 4,282,080 | 8/1981 | Muller et al. | 204/428 X |
| 4,296,148 | 10/1981 | Friese | 204/195 S |
| 4,300,990 | 11/1981 | Maurer | 204/195 S |
| 4,358,265 | 11/1982 | Tanaka et al. | 431/76 |

FOREIGN PATENT DOCUMENTS

| | | | |
|---|---|---|---|
| 51-116438 | 10/1976 | Japan . | |
| 51-142730 | 12/1976 | Japan . | |
| 54-113531 | 9/1979 | Japan | 431/76 |
| 54-125543 | 9/1979 | Japan . | |
| 54-159745 | 12/1979 | Japan | 431/76 |
| 1523550 | 9/1978 | United Kingdom | 204/426 |

*Primary Examiner*—Larry Jones
*Assistant Examiner*—Carl D. Price
*Attorney, Agent, or Firm*—Oblon, Fisher, Spivak, McClelland & Maier

[57] ABSTRACT

A gas combustion apparatus is disclosed wherein an oxygen sensor having electrodes on both surfaces of a base body is fixed in advance at a position such that the oxygen sensor is within the exhaust gas a combustion flame under normal conditions and a combustion flame under oxygen deficiency conditions is brought into contact with only the measuring side electrode. The oxygen sensor is preferably mounted to a heat-resistance holder having an opening such that the measuring side electrode corresponds with the opening.

5 Claims, 9 Drawing Figures

GAS COMBUSTION APPARATUS CAPABLE OF DETECTING ENVIRONMENTAL OXYGEN DEFICIENCY

The present invention relates to a gas combustion apparatus which is capable of detecting environmental oxygen deficiency with an oxygen sensor.

Recently, carbon monoxide poisoning caused by incomplete combustion by heaters in homes under conditions of oxygen deficiency is increasing. In order to prevent this, a gas combustion apparatus has been developed and put in use which measures with an oxygen sensor the oxygen concentration of the exhaust gas and which stops the supply of combustible gas or generates an alarm in the event of oxygen deficiency.

An oxygen sensor used in such a gas combustion apparatus comprises a base body of an oxygen ion conductive solid electrolyte such as a zirconia type ceramic fired body with porous electrodes of fired platinum paste adhered to both sides thereof. This oxygen sensor generates an electromotive force corresponding to the oxygen partial pressure difference between the atmosphere at the measuring side corresponding to one electrode and that at the reference side corresponding to the other electrode. In the application of such an oxygen sensor, it is important that the measuring side atmosphere and the reference side atmosphere be separated from each other. As a solution to this problem, Japanese Laid Open Patent Application No. 51-116438 discloses a combustion apparatus wherein an oxygen sensor is used which has two electrodes inside and outside a cylindrical base body with a bottom. Fresh air is supplied to the inside and the exhaust gas of the combustion flame is in contact with the outside. Japanese Laid Open Patent Application No. 51-142730 discloses a combustion apparatus wherein a bottom of a cylindrical oxygen sensor has a small hole, combustible gas is supplied to the inside of the sensor, and the exhaust gas is in contact with the outside thereof. However, these apparatuses have drawbacks in that a separate means is required to supply air or combustible gas to the inside of the cylindrical oxygen sensor, the manufacture of the cylindrical oxygen sensor is complex, and so on.

Japanese Laid Open Patent Application No. 54-125543 discloses a combustion apparatus wherein a flat oxygen sensor has an electrode on both surfaces, one electrode is in contact with the exhaust gas of the combustion flame, and the other electrode is in contact with a reference burner flame combusting under constant oxygen deficiency. However, this apparatus requires a separate reference burner which combusts under oxygen deficiency, and the structure of the apparatus is complex.

It is an object of the present invention to provide a gas combustion apparatus which is simple in construction and which is capable of correctly detecting oxygen dificiency.

According to the gas combustion apparatus of the present invention, a flat oxygen sensor is prefixed in a position such that, under the normal combustion condition, both electrodes at the measuring side and the reference side are in the combustion exhaust gas and, under the oxygen deficiency condition, the combustion flame elongated in size by the incomplete combustion is in contact only with the measuring side electrode.

Preferably, the oxygen sensor of the present invention is fixed to a heat-resistant holder with an opening in such a manner that a measuring side electrode is exposed through this opening and the electrode opposes the combustion flame.

The combustion apparatus of the present invention is extremely simple in construction since a separate means for supplying a reference gas such as air to the reference side electrode of the oxygen sensor is not required. Furthermore, according to the preferred arrangement described above, the danger of the imcomplete combustion flame contacting the reference side electrode may be completely eliminated so that correct and stable detection of oxygen deficiency may be possible.

This invention can be more fully understood from the following detailed description when taken in conjunction with the accompanying drawings, in which.

Figure 1:
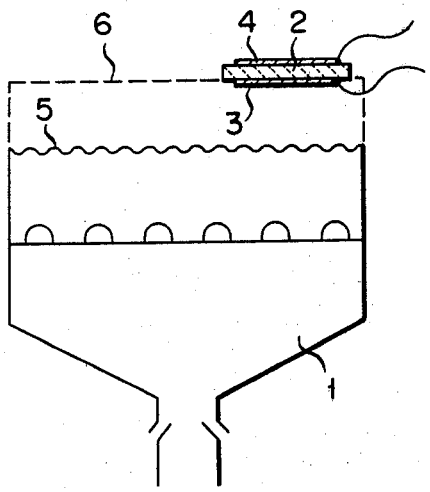
FIG. 1 is a schematic sectional view of a gas combustion apparatus according to the present invention.

In the gas combustion apparatus shown in FIG. 1, a plate-shaped oxygen sensor 2 above a burner 1 is arranged with a measuring side electrode 3 facing downward. Under the normal combustion condition, the flame is under the condition shown by a solid line 5 and is thus separated by a considerable distance from the oxygen sensor 2. Therefore, there is substantially no oxygen concentration difference between the upper side (reference side electrode 4) and the lower side (the measuring side electrode 3) of the oxygen sensor 2 which is surrounded by a uniform atmosphere of combustion exhaust gas containing oxygen. The output of the oxygen sensor 2 is substantially zero under this condition. However, under the oxygen deficiency condition, the flame becomes elongated, as shown by a dotted line 6, due to incomplete combustion and contacts the measuring side electrode 3 of the oxygen sensor 2. Under this condition, the reference side electrode 4 of the oxygen sensor is still in contact with the atmosphere containing the combustion exhaust gas. Since the measuring side electrode 3 is in contact with the flame 6, the oxygen partial pressure there is close to zero. On the other hand, the reference side electrode 4 is in an atmosphere of a gas mixture containing the combustion exhaust gas, oxygen supplied from the outside and so on. Therefore, the oxygen partial pressure there is relatively high as compared with the measuring side. As a result, under this oxygen deficiency condition, a large oxygen partial pressure difference between the two surfaces of the oxygen sensor 2 is generated, and the oxygen sensor 2 outputs a signal as an electromotive force so that the oxygen deficiency may be detected.

Figure 2:
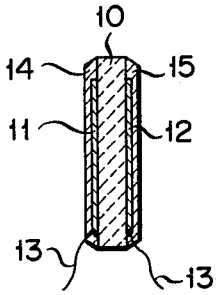
FIGS. 2, 3 and 4 are sectional views of the oxygen sensor used in the present invention.

The oxygen sensor, as shown in FIG. 2, comprises a flat base body 10 of an oxygen ion conductive solid electrolyte, a measuring side electrode 11 formed on one surface of the base body 10, a reference side electrode 12 formed on the other surface of the base body 10, lead wires 13 of platinum or the like mounted to both electrodes, and heat-resistant protective layers 14 and 15 formed on the electrodes 11 and 12, respectively. The oxygen ion conductive solid electrolyte of the base body 10 may be fired body containing as a main constituent at least one member selected from the group consisting of $ZrO_2$, $HfO_2$, $CeO_2$ and $ThO_2$, and further containing as an additive at least one member selected from the group consisting of CaO, MgO, $Y_2O_3$, $Yb_2O_3$, $Gd_2O_3$ and $Sc_2O_3$; or a fired body containing as a main constituent $Bi_2O_3$ and at least one of the aforementioned additional components. $ZrO_2$-$Y_2O_3$ type ceramics may typically be used. The shape of the base body 10 may be arbitrarily selected depending upon the conditions. For example, it may be circular or rectangular.

The electrodes 11 and 12 are porous electrodes made of a noble metal or an oxide of a particular metal. Preferable noble metals may include Pt, Rh, Pd, Ag, and Au. For forming the porous electrodes from these noble metals, it is general practice to make the material into a paste, apply the paste to the required portion of the base body, and to fire it. However, other methods may also be adopted such as vacuum evaporation, sputtering, plasma spray coating, and electroless plating. The metal oxides which may be used for the material of the electrodes may include ruthenium oxide ($RuO_2$); bismuth ruthenate ($Bi_2Ru_2O_7$); zinc oxide (ZnO); ZnO containing preferably 1 to 10 mole % of at least one of aluminum oxide ($Al_2O_3$) and zirconium dioxide ($ZrO_2$); $SnO_2$-$In_2O_3$ type solid solution (e.g., containing 2 mole % of $SnO_2$); perovskite compounds such as $RaCoO_3$, $PrCoO_3$, and $LaCrO_3$; and so on. For forming porous electrodes from these metal oxides, a powder of such a metal oxide is formed into a paste with a suitable binder (e.g., glass frit, cellulose acetate or the like added to a solvent such as ethyl acetate), the paste is applied to the required portion of the base body, and the base body with the paste is fired. A convenient firing temperature is 700° to 1,000° C.

For adhering the lead wires 13 to the electrodes 11 and 12, platinum paste or the like may be applied and fired. When the electrodes are made of a metal oxide, it is preferable to adhere the lead wires with a paste of the same metal oxide and fire them. The protective layers 14 and 15 of the electrodes 11 and 12 may be formed by plasma spray coating of a heat-resisitant inorganic compound or adhering it with an organic binder and thereafter firing it. The heat-resistant inorganic compound may be zirconium oxide, aluminum oxide, magnesium oxide, spinel or the like.

Figure 3:
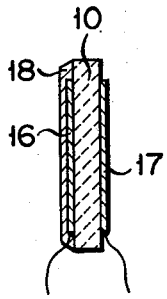
Figure 4:
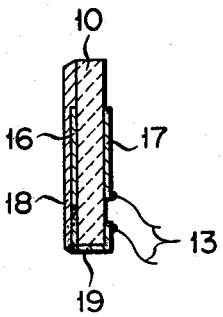

When the electrodes are made of a metal oxide, the thermal expansion coefficient (70 to $90\times10^{-7}$ cm/deg) of the metal oxide is very similar to the thermal expansion coefficient ($90\times10^{-7}$ cm/deg) of the inorganic oxide solid electrolyte of the base body. Moreover, both these materials are inorganic oxides. Therefore, chemical bonding is obtained at the interface resulting in good adhesion. Thus, even when a measuring side electrode 16 is made of platinum, a reference side electrode 17 is made of a metal oxide and the measuring electrode 16 alone is covered with a protective layer 18 as shown in FIG. 3, the reference side electrode 17 of the metal oxide may not peel off during use. More preferably, as shown in FIG. 4, at least part 19 of the measuring side electrode 16 is extended to the reference side surface of the base body 10 and the lead wire 13 is adhered to the extended part of the reference side. With an electrode of such a construction, the adhesion of the lead wire may be easy and the adhering portion may be spaced apart from the combustion flame.

Figure 5:
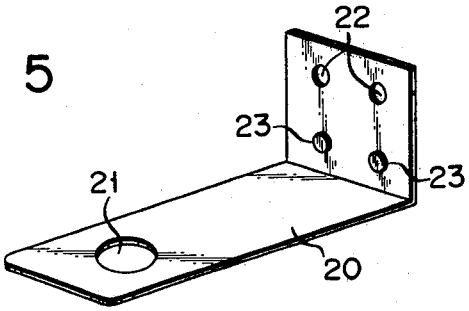
FIG. 5 is a perspective view of a plate-shaped holder for mounting the oxygen sensor.

The oxygen sensor is fixed to the plate-shaped holder shown in FIG. 5 and is mounted at a predetermined position in a combustion apparatus. A holding plate 20 is made of a heat-resistant metal material such as stainless steel. A hole 21 is formed in the holding plate 20 at a position to correspond with the measuring side electrode when the oxygen sensor is in place with the measuring side electrode facing the holding plate (20). The hole 21 is a guide for bringing the gas to be measured in contact with the measuring side electrodes 11 and 16, and its shape may be arbitrary, such as circular or rectangular. The area of the holding plate 20 for placing the oxygen sensor thereon is preferably greater than the area of the sensor. One end of the holding plate 20 is bent to stand at right angles as shown in the figure. Screw holes 22 through which the holding plate may be fixed with screws or caulkings at the predetermined position in the combustion apparatus are formed at this one end. Insulating terminals 23 for extending the lead wires 13 of the oxygen sensor therethrough are further formed at this one end.

Figure 6:
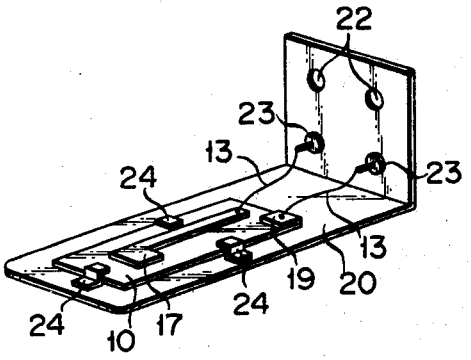
FIG. 6 is a perspective view illustrating the mounted condition of the oxygen sensor of FIG. 4 to the holder of FIG. 5.

FIG. 6 shows the construction according to which the oxygen sensor of FIG. 4 is mounted to the holding plate of FIG. 5. The oxygen sensor is placed on the holding plate 20 in such a manner that part or all of the measuring side electrode 16 of the oxygen sensor corresponds with the hole 21 to be exposed to the outside, and the oxygen sensor is fixed with holding tools 24. The lead wires 13 fixed to the part 19 of the measuring side electrode 16 which extends toward the reference side and the reference side electrode are connected to the insulating terminals 23. The shapes of the oxygen sensor and the electrodes need not be rectangular but may be arbitrarily selected; for example, they may be circular. By holding the oxygen sensor to the plate-shaped holder, the oxygen sensor may be mounted at a predetermined position of the combustion apparatus in a stable manner. Since the gas to be measured (combustion exhaust gas) is not in direct contact with the solid electrolyte or the welded portion between the electrodes and the lead wires, damage to these members is reduced to the minimum. The problem of elongation of the flame to the reference side electrode due to the oxygen deficiency and the resultant decrease in the electromotive force may be solved by controlling in advance the area of the holding plate.

Figure 7:
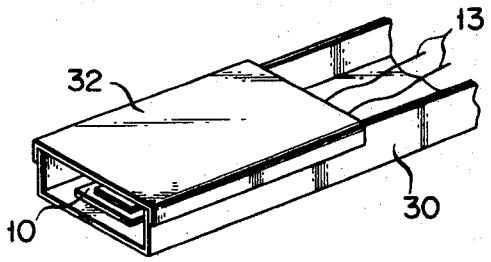
FIG. 7 is a perspective view of a cylindrical holder mounting the oxygen sensor.
Figure 8:
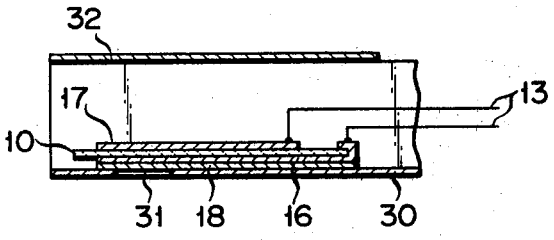
FIG. 8 is a sectional view of the cylindrical holder of FIG. 7 which mounts the oxygen sensor.

FIGS. 7 and 8 show an oxygen sensor held on a cylindrical holder as another preferred construction. The cylindrical holder comprises a bottom plate 30 with two sides and a cover 32 and is made of a heat-resistant metal such as stainless steel. A hole 31 is formed in part of the bottom plate 30. The oxygen sensor is mounted to the holder in such a manner that at least part of the measuring side electrode 16 of the oxygen sensor is brought in contact with the combustion exhaust gas through the hole 31 via the protective layer 18. The cover 32 is fixed to the bottom plate 30 by, for example, welding to provide a cylindrical holder with two open ends. The shape and size of the cylindrical holder may be suitably selected depending upon the shape and size of the oxygen sensor. However, the cylindrical holder is preferably a cylindrical body having a rectangular sectional area. The shape of the hole 31 is arbitrary, such as circular or rectangular.

With the combustion apparatus of the construction shown in FIGS. 7 and 8, the oxygen sensor may be fixed at a predetermined position in the combustion apparatus in a correct and stable manner. Since the combustion flame and the exhuast gas are not in contact with the welding part between the electrodes and the lead wires, damage to this part is small. The combustion apparatus has further advantages to be described below. When the combustion flame lengthens due to oxygen deficiency, this flame is brought into contact with only the measuring side electrode 16 through the hole 31 and not with the reference side electrode 17. Thus, the problem of contact of the flame with the reference side electrode with the accompanying decrease in the electromotive force may be solved. Furthermore, since both ends of the cylindrical holder are open, the flow of air is extremely smooth due to the effective tunnel. As a result, the reference side electrode may be in constant contact with fresh air. Therefore, the generation of an electromotive force in the event of oxygen deficiency is distinct.

The combustion apparatus of the present invention may be applied to combustion apparatuses for combustible gases such as natural gas and propane gas as well as to gasified petroleum burners. Those skilled in the art may be able to construct an automatically extinguishable apparatus according to which the supply valve of the combustible gas is closed in response to an electric signal generated when the oxygen sensor detects an oxygen deficiency.

The present invention will now be described with reference to its examples.

EXAMPLE 1

Oxygen sensors as shown in FIG. 3 were manufactured with different materials for the reference side electrode. Disk-shaped base bodies (20 mm diameter and 1 mm thickness) comprising $ZrO_2$ fired bodies containing 8 mole % of $Y_2O_3$ were prepared. Paste of platinum was applied in a circle of 10 mm diameter at the center of one surface (measuring side) of each base body. A paste of material listed in Table 1 was applied in a circle of 10 mm diameter at the center of the opposite surface (reference side) of each base body. The base bodies with applied pastes were fired at a temperature of 900° C. for 10 minutes to form electrodes. A platinum lead wire was adhered with platinum paste to each platinum electrode. A platinum lead wire was adhered to each reference side electrode with a paste of the same metal oxide as that used for the reference side electrode. A heat treatment at 900° C. was performed for adhering the lead wires. A powder of zirconium was sprayed by plasma spray coating to form protective layers covering the welding portions between the measuring side platinum electrodes and the lead wires to provide oxygen sensors.

These oxygen sensors were subjected to an endurance test (heat cycle) according to which the measuring side with the protective layer facing toward the front of a total primary air mixing burner (so-called Shbunk burner), the burner and sensor were arranged to be substantially parallel to each other with a distance of about 2 mm therebetween, and the burner was lit and extinguished at intervals of 10 minutes. For the purpose of comparison, oxygen sensors similar to those of the example except that the reference side electrode was also of platinum were manufactured and were subjected to the same test. The number of samples was 10 for each group of oxygen sensors. Table 1 shows the number of oxygen sensors which were found to have troubles at 10, 100, and 10,000 heat cycles.

It is seen from the table that the sensors with the reference side electrode of the metal oxide were free of troubles and had high reliability.

TABLE 1

| | Reference side electrode | Heat cycles (number of times) | | |
|---|---|---|---|---|
| | | 10 | 100 | 1,000 |
| Sample 1 | Pt | 0 | 7 | 10 |
| Sample 2 | $Bi_2Ru_2O_7$ | 0 | 0 | 0 |
| Sample 3 | $RuO_2$ | 0 | 0 | 0 |
| Sample 4 | $ZnO—Al_2O_3$ (2 mole %) | 0 | 0 | 0 |
| Sample 5 | $ZnO—ZrO_2$ (3 mole %) | 0 | 0 | 0 |
| Sample 6 | $LaCoO_3$ | 0 | 0 | 0 |
| Sample 7 | $In_2O_3—SnO_2$ (2 mole %) | 0 | 0 | 0 |

EXAMPLE 2

Figure 9:
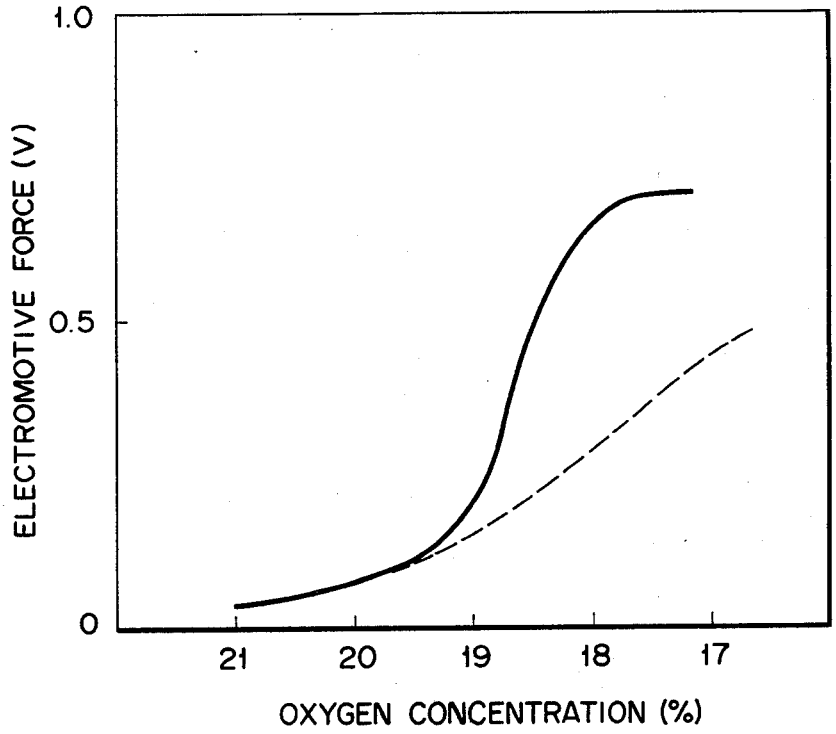
FIG. 9 shows the relationship between the oxygen concentration and the electromotive force.

An oxygen sensor of Sample 1 of Example 1 was mounted to a holding plate of stainless steel having a 3 cm width as shown in FIG. 5 in such a manner that the measuring side electrode corresponded with the hole. This oxygen sensor was arranged to be substantially parallel with a Shbunk burner in such a manner that the measuring side electrode was 0.3 cm above the burner. The burner was lit and the oxygen concentration of the atmosphere was gradually decreased. The electromotive force of the oxygen sensor was measured. The flame in complete combustion did not reach the oxygen sensor, the exhaust gas surrounded the sensor, and no electromotive force was recorded. As the oxygen concentration decreased, the combustion flame became elongated. At an oxygen concentration of about 19.5%, the flame began to contact the measuring side electrode of the oxygen sensor and the electromotive force was abruptly raised to about 0.5 V. At an oxygen concentration of about 18.5%, the flame was further elongated and the electromotive force recorded a peak value. When the flame was elongated still further, the decrease in the electromotive force was extremely small since the holding plate reduced the elongation of the flame toward the reference electrode side to the minimum. FIG. 9 shows the relationship between the oxygen concentration and the electromotive force. The solid line in the graph corresponds to the present invention and the broken line corresponds to the conventional cylindrical oxygen sensor with a bottom.

What we claim is:

1. A gas combustion apparatus including at least one burner for producing a flame, said apparatus including a flat oxygen sensor for producing a control signal for control of the combustion apparatus, said flat oxygen sensor being arranged to be exposed to said flame of only one said at least one burner, said sensor having electrodes on both a measuring side and a reference side thereof and which is capable of detecting oxygen deficiency of combustion exhaust gas wherein said flat oxygen sensor is prefixed in a position relative to said burner such that, under a normal combustion condition, said electrodes at both the measuring side and the reference side are in the combustion exhaust gas and, under an oxygen deficiency condition wherein said flame is elongated in size by the incomplete combustion said flame is in contact only with said measuring side electrode, and wherein said oxygen sensor is mounted to a holder of a heat-resistant metal having an opening such that the position of at least part of said measuring side electrode corresponds with said opening.

2. A gas combustion apparatus according to claim 1, wherein said holder comprises a cylindrical holder consisting of a bottom plate having two sides and said opening and a cover covering said oxygen sensor mounted to said bottom plate.

3. A gas combustion apparatus according to claim 1, wherein said oxygen sensor comprises a flat base body of an oxygen ion conductive solid electrolyte, porous measuring side and reference side electrodes formed on respective surfaces of said base body, lead wires mounted to both said electrodes, heat-resistant protective layers formed at least on said measuring side electrode.

4. A gas combustion apparatus according to claim 3, wherein said measuring side electrode is made of at least one member selected from the group consisting of Pt, Rh, Pd, Ag and Au.

5. A gas combustion apparatus according to claim 3, wherein said reference side electrode is made of one member selected from the group consisting of ruthenium oxide, bismuth ruthenium, zinc oxide, zinc oxide containing aluminum oxide or zirconium dioxide, tin oxide-indium oxide solid solution, and perovskite compounds.

* * * * *